US007275472B1

(12) United States Patent
Finn

(10) Patent No.: US 7,275,472 B1
(45) Date of Patent: Oct. 2, 2007

(54) GAS RING FOR FIREARM

(75) Inventor: James Finn, Alpha, IL (US)

(73) Assignee: Rock River Arms, Inc., Cleveland, IL (US)

( * ) Notice: Subject to any disclaimer, the term of this patent is extended or adjusted under 35 U.S.C. 154(b) by 523 days.

(21) Appl. No.: 10/997,420

(22) Filed: Nov. 23, 2004

Related U.S. Application Data

(60) Provisional application No. 60/542,003, filed on Feb. 5, 2004.

(51) Int. Cl.
*F41A 3/74* (2006.01)

(52) U.S. Cl. ..... 89/26

(58) Field of Classification Search ..... 89/26, 89/191.01
See application file for complete search history.

(56) References Cited

U.S. PATENT DOCUMENTS 3,572,729 A * 3/1971 Hodil, Jr. ..... 277/647
3,648,562 A * 3/1972 Loeble ..... 89/185
3,777,614 A * 12/1973 Scanlon ..... 89/26

* cited by examiner

*Primary Examiner*—Stephen M. Johnson
(74) *Attorney, Agent, or Firm*—Banner & Witcoff, Ltd.

(57) ABSTRACT

A bolt assembly for a direct gas firearm includes a plurality of sealing rings. In an embodiment, there are three rings with ring gaps cut at about a 45 degree angle and the middle ring is flipped so that the angle of the gap of the middle ring is approximately 90 degrees from the angle of the gap of the two outer rings. In an embodiment, the angle of the ring gap of at least one of the plurality of sealing rings is between 0 and 90 degrees and the ring is configured so that the ring gap is minimized once the ring is installed.

11 Claims, 3 Drawing Sheets

GAS RING FOR FIREARM

CROSS-REFERENCE TO RELATED APPLICATIONS

This application claims priority to U.S. Provisional Application Ser. No. 60/542,003, filed Feb. 5, 2004.

BACKGROUND OF THE INVENTION

1. Field of the Invention

The present invention relates generally to the field of firearms and more specifically to the field of direct gas based firearms.

2. Description of Related Art

Semi-automatic and automatic firearms using a direct gas receiver are known, having been used extensively for recreational and military purposes. While such firearms have numerous objectives, two important objectives include reliability and accuracy.

Conventional direct gas automatic or semiautomatic firearms include a receiver configured to accept a longitudinally reciprocatable bolt assembly, the bolt assembly moveable between a recoiled or retracted position and a battery position. The bolt assembly includes a firing pin that is slidably mounted to the bolt assembly. As is known, the movement of the bolt assembly from the recoiled to the battery position causes a hammer to rotate to a cocked position. A user, by actuating a firearm's trigger, releases a hammer from a cocked position, thereby causing the hammer to strike a firing pin. The force exerted on the firing pin causes the firing pin to move forward until the firing pin strikes a chambered cartridge, thereby firing the cartridge in the firearm.

The firing of the cartridge causes a sudden explosion of gas that propels a bullet down a barrel of the firearm. The gas from the explosion is also used to force the bolt assembly into the recoiled position. A spring operates to resist the movement of the bolt assembly toward the recoiled position and operates to return the bolt assembly back to the battery position. As the bolt assembly returns back to the battery position, the bolt assembly strips a cartridge from the magazine and chambers the next cartridge in the barrel. Unless the weapon is in automatic fire mode, the firearm does not fire another cartridge until the trigger is actuated again.

More specifically, the gas used to force the bolt assembly into the recoiled position is provided through a gas port formed in the barrel. The gas port allows the expanding gas caused by the firing of the cartridge to enter an operatively connected tube that directs the expanding gas back to a key in the bolt carrier group. The expanding gas passes through the key, which is typically a cylindrical hollow rod and enters a chamber in the carrier group. The chamber surrounds a portion of the bolt that is slidably mounted to the bolt group. The increase in gas pressure in the chamber causes the bolt to move away from the battery position toward a recoiled position. In order to provide consistent recoil of the bolt and bolt carrier group, it is necessary that a seal is formed between the bolt and the chamber in the bolt carrier group.

In order to achieve this seal, typically three gas rings are placed in a circular groove formed in the bolt. The gas rings are used to provide a seal between the bolt and the chamber. To aid in the installation, removal, and cleaning of the gas rings, the rings have a gap cut in them that allows the rings to be snapped around the bolt and into the groove formed in the bolt.

Problems exist, however, with respect to the known gas rings. For example, the current gap formed in the gas rings is a radially extending gap. This gap is formed by the opposing ends of the gas ring which define radially extending mating surfaces. The radially extending gaps of adjacent gas rings when aligned, even when compressed, tend to allow the gas to blow by or escape through the gas rings, thereby greatly diminishing the effect of the seal. In the past, to address this problem the gas rings have been installed in a staggered manner such that the gaps in the adjacent gas rings are not aligned along the length of the bolt. With this configuration, there is no direct passage for the expanding gas to blow by the gas rings. While this configuration has been mostly effective, this installation has resulted in a more complex assembly of the firearm. This configuration also requires the user to take care that the ring gaps are not aligned. In addition, this configuration does not eliminate the possibility of the gaps becoming aligned, causing the firearm to not operate properly. As can be appreciated, having the firearm fail due to gas blow-by at an inopportune time may create a hazardous situation to an individual's well being.

Other attempts to solve the problem of gas blow-by have been with the use of a continuous wire ring similar to a key-chain ring. The continuous wire ring has been somewhat effective at preventing blow-by but sometimes causes operation problems when the ring becomes heated causing the entire length of the ring to expand resulting in an inoperable condition, due to binding of the bolt and carrier. Other attempts to solve the problem of gas blow-by have been tried but have been mostly unsuccessful. Consequently, there still exists a need in the art to provide a seal between the bolt and the chamber that prevents the undesirable gas blow-by.

BRIEF SUMMARY OF THE INVENTION

A bolt assembly for a direct gas firearm includes a plurality of sealing rings for use in providing sealing between a ring groove and a sealing surface. In an embodiment, at least one of the rings has an angled gap rather than a radial gap. In another embodiment, there are three rings with gaps cut at a 45 degree angle and the middle ring is flipped so that the angle of the gap of the middle ring is approximately 90 degrees from the angle of the gap of the two outer rings. In yet another embodiment, the angle of at least one of the plurality of sealing rings is configured so that the gap is minimized once the ring is installed.

BRIEF DESCRIPTION OF THE DRAWINGS

The present invention is illustrated by way of example and not limited in the accompanying figures in which like reference numerals indicate similar elements and in which.

Figure 1A:
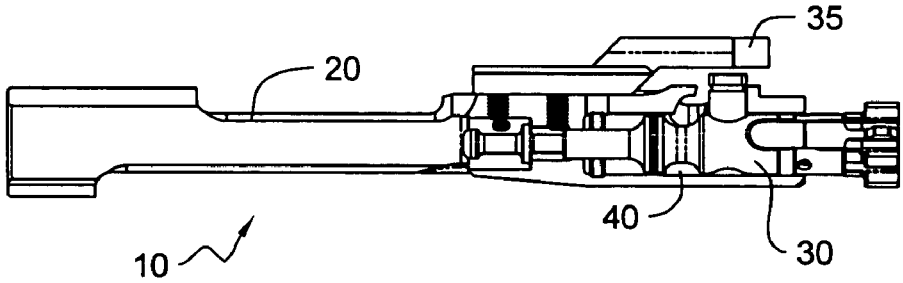
FIG. 1*a* illustrates a cutaway side view of an embodiment of a bolt assembly.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE INVENTION

Figure 2:
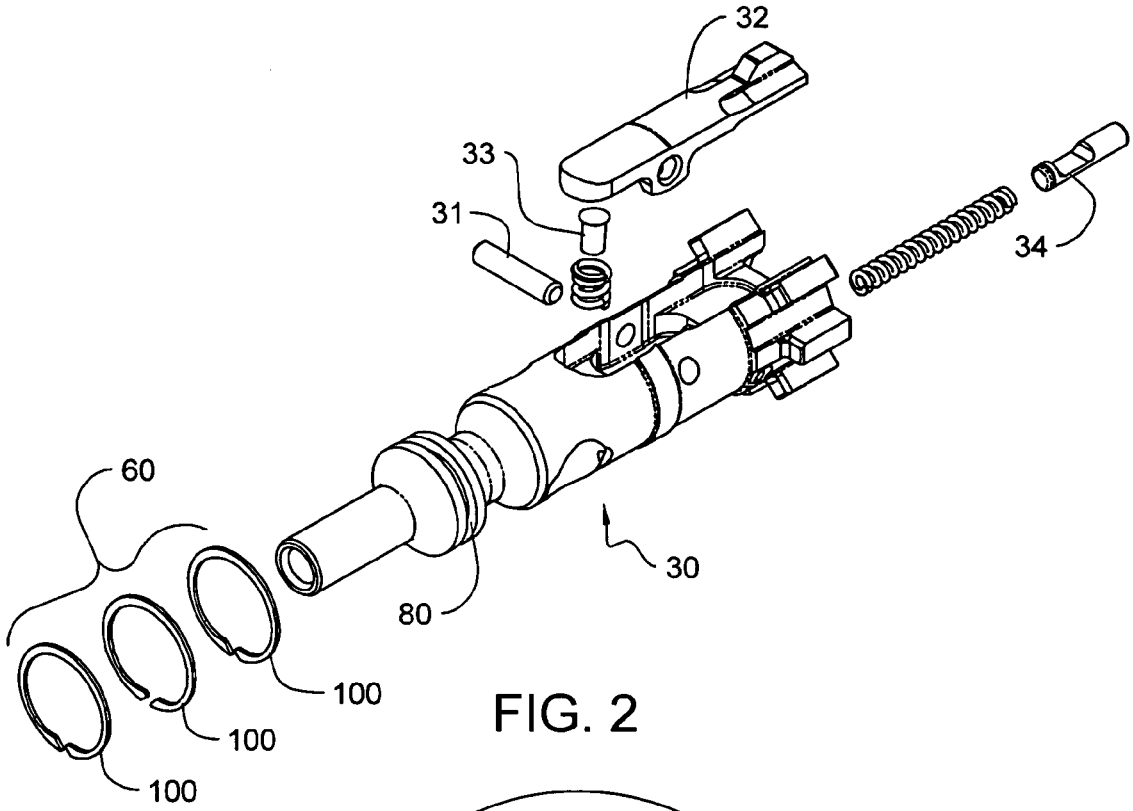
FIG. 2 illustrates a partial exploded isometric view of a bolt and the sealing rings.
Figure 3:
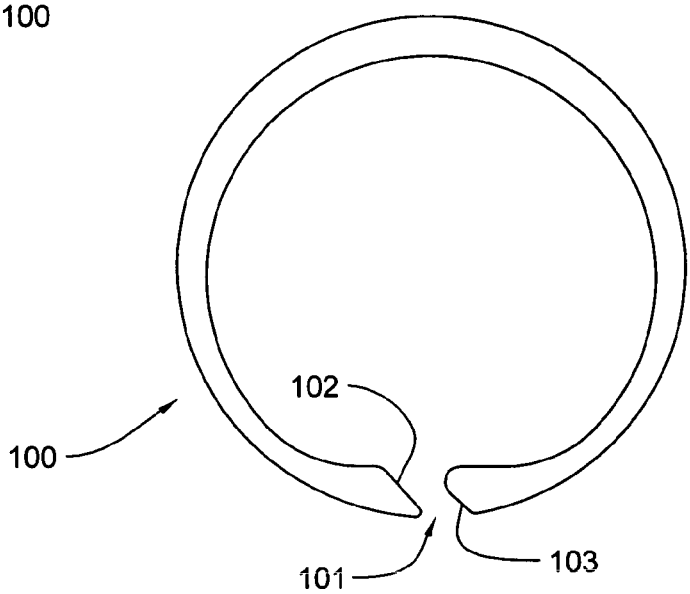
FIG. 3 illustrates a plan view of an exemplary embodiment of a sealing ring.
Figure 4:
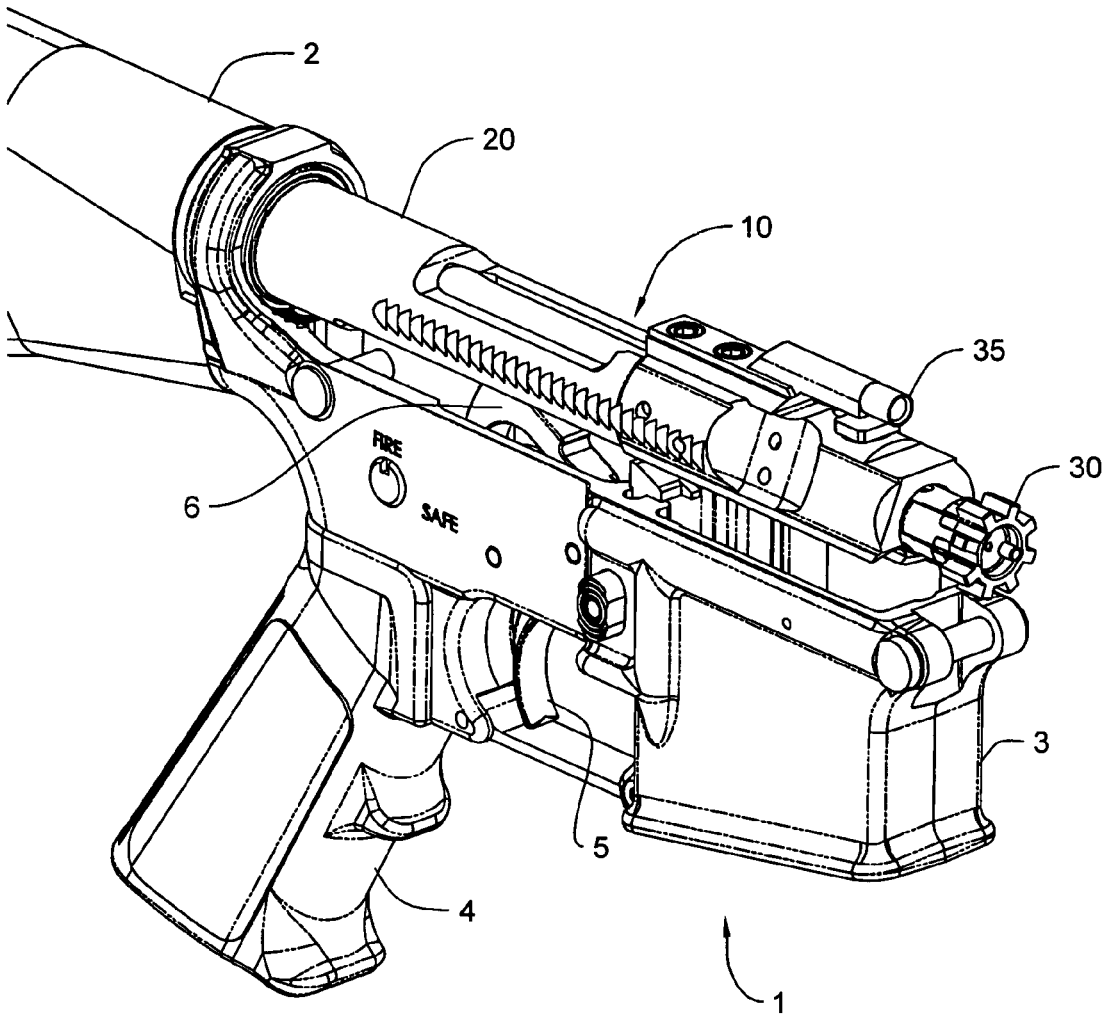
FIG. 4 illustrates a partial isometric view of an exemplary embodiment of a firearm.

FIGS. 1-4 disclose exemplary embodiments of the present invention. Turning first to FIG. 4, an exemplary partial view of a direct gas firearm is depicted. Firearm 1 includes a stock 2 and a lower receiver 3 mounted to the stock. A grip 4 is mounted on the lower receiver 3 and provides a rest for the hand of the user planning to operate the firearm 1. In operation, the user pulls a trigger 5 that is mounted on the lower receiver 3, and the actuation of the trigger 5 releases a hammer 6 that is also mounted on the lower receiver 3. The hammer 6, being spring loaded, strikes a firing pin (not shown) that is slidably mounted in a bolt assembly 10.

The firing pin strikes a cartridge (not shown) and causes a powder in the cartridge to explode, creating a rapidly expanding gas. The expanding gas forces a bullet down a barrel (not shown) towards the intended target. A portion of the expanding gas enters a channel in an upper receiver (also not shown) and is directed back towards the bolt assembly 10, which includes a bolt carrier 20 and a bolt 30. The expanding gas enters the key 35, and in a manner that will be discussed below, causes the bolt assembly 10 to move rearward.

An operating spring (not shown) resists the rearward movement of the bolt assembly 10 until the spring force is sufficient to stop further rearward movement of the bolt assembly 10 (i.e., the bolt assembly 10 reaches a recoil position). As the gas pressure quickly dissipates, the bolt assembly 10 is than directed forward by the operating spring until the bolt assembly 10 is once again in a battery position (i.e., ready to fire another cartridge). Thus, the bolt assembly 10 reciprocates back and forth based on the sudden increases in gas pressure caused by firing the cartridge and the spring force from the operating spring. While the bolt assembly is reciprocating backward, the spent cartridge is ejected and while the bolt assembly is moving forward a new cartridge is loaded.

Problems may result if gas blow-by occurs. For example, if the bolt assembly does not travel far enough in the rearward direction, the spent cartridge cannot be ejected properly. If this happens, the firearm 1 may either jam or the user may be forced to manually cycle the bolt assembly 10 through the required range of travel. Either result will be unexpected and potentially harmful to the individual relying on the operability of the firearm.

The present invention is directed toward ensuring the bolt assembly 10 reciprocates in a desired manner so that the firearm 1 functions properly.

Returning back to FIGS. 1*a*-3, the present invention provides a solution to the problems associated with gas blow-by. FIG. 1*a* depicts a typical bolt assembly 10 for use in a direct gas firearm. The bolt assembly 10 includes a bolt carrier 20 and a bolt 30. The gas pressure created by the firing of the cartridge is communicated through a key 35 and is directed in a chamber 40. The chamber 40 is created by a gap between the bolt 30 and the bolt carrier 20.

Figure 1B:
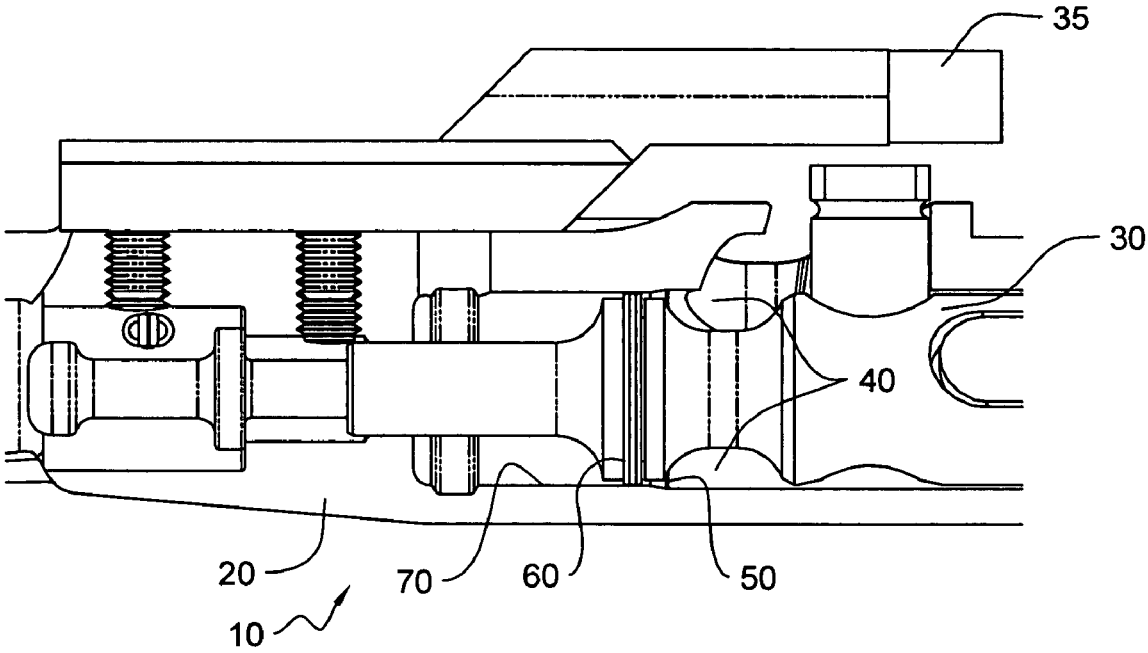
FIG. 1*b* illustrates a close-up cutaway side view of the chamber and surrounding components as depicted in FIG. 1*a*.

FIG. 1*b* illustrates an expanded view of the chamber 40 and surrounding components. In operation, a sudden increase in pressure in the chamber 40 causes a force to be exerted on the bolt shoulder 50. To contain the sudden increase in pressure and to force the bolt assembly 10 to move rearward, a ring set 60 is mounted on the bolt 30. The ring set 60 provides a seal between the bolt 30 and a bolt carrier wall 70. Thus, the bolt 30 is first pushed in a rearward direction and the rearward movement of the bolt 30 causes the bolt 30 to rotate. Once bolt 30 fully rotates, the bolt assembly 10 is no longer locked in the battery position and the gas pressure causes the bolt assembly 10 to move in the rearward direction.

FIG. 2 depicts an exploded view of an exemplary embodiment of the bolt 30. An extractor pin 31 is configured to restrain an extractor 32. An extractor plunger 33 is spring loaded and exerts a force on the extractor 32 so that when the extractor 32 pivots over the cartridge head, the extractor plunger 33 forces the extractor 32 back down so as to capture the head of the cartridge. Thus, when the bolt moves in a rearward direction, the extractor pulls the spent cartridge casing from the chamber. An ejector 34 is also spring loaded and as the bolt assembly travels rearward toward the recoil position the ejector 34 causes the spent cartridge casing to be ejected, as the end of the casing clears the barrel. The bolt 30 includes a ring groove 80 configured to accept the ring set 60. As depicted, the ring set 60 comprises, in one embodiment, three rings 100, one of which is flipped. In an alternative embodiment, the ring set 60 consists of two rings. As is readily apparent, replacing the three rings with two rings requires the use of a slightly thicker ring if the rings are to fill the space provided by the ring groove 80.

FIG. 3 illustrates an exemplary embodiment of a ring 100 according to the present invention. As depicted, the ring 100 has an angled ring gap 101. When installed, a ring end 102 is pressed against a ring end 103. As depicted, ring end 102 and ring end 103 are at complementary angles about 45 degrees from a straight radial line.

As shown in FIG. 3, which depicts an embodiment of a ring in an uncompressed condition, such as prior to installation of the gas ring, the ring gap 101 between the ring ends is greater than the ring gap of the ring ends after installation of the gas ring. In other words, when the ring is in the installed and compressed position, the ring gap is significantly reduced as compared to the uncompressed state. Thus, the ring ends are configured to take into account the deflection caused by installation and compression. In this manner, the ring gap 101 is minimized when installed while still allowing the ring set 60 to be removed from the ring grove 80 for cleaning.

In an embodiment, a first and second ring, both with substantially similar ring gap angles, are used. If the first ring is flipped over in comparison to the second ring, the ring gap of the second ring will be installed at an angle that is the negative angle of the ring gap of the first ring. In other words, the angle of the ring gap of the second ring will be equal to the angle of the ring gap of the first ring minus 90 degrees. With this configuration, the gaps of the gas rings cannot align and thus the undesirable gas blow-by is prevented. One skilled in the art will understand that other shapes, orientations, and configurations of the rings and gaps formed in the gas rings are possible with the concepts and teachings of the present invention.

As can be appreciated, the use of at least one ring 100 with an angled ring gap 101 will improve the sealing characteristic of the ring set 60. In an exemplary embodiment, a plurality of rings 100 are used where each ring 100 has an angled ring gap 101.

While the ring gap 101, as shown, has about a 45 degree angle, other angles are contemplated. Any non-radial ring gap could be used with the present invention. The range of angle could be between 0 and 90 degrees, however, it is preferable that the angle of the ring gap be between 15 and 75 degrees and even more preferable to be between 30 and 60 degrees. Again, all gap angles between 0 and 90 degrees could be used with the present invention, as well as various combinations of rings having different gap angles.

In an embodiment, the ring set 60 comprises three rings 100 with the angled ring gap 101 having an angle of 45 degrees from a straight radial line. In an exemplary installation, the middle ring 100 is flipped in relation to the two outer rings 100 so that the angle of the ring gap 101 of the middle ring is approximately 90 degrees different from the angle of the ring gaps 101 of the two outer rings.

In alternative exemplary embodiment, the ring set 60 comprises at least two rings. In this embodiment, the angle of a ring gap of a first ring is different from the angle of a ring gap of a second ring. In an embodiment, the angle of the ring gap of the first ring is about 30 degrees and the angle of the ring gap of the second ring is about 60 degrees. While the use of a ring set comprising rings with different angles of ring gap increases the complexity of manufacturing, the installation process becomes more robust because even without flipping one ring over, it is not possible for the ring gaps to align and thus the undesirable gas blow-by is prevented. One skilled in the art will understand that a ring set comprising three rings each having an angled ring gap where each ring has a different ring gap angle is also contemplated.

Variations and modifications of the foregoing are within the scope of the present invention. It should be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

What is claimed is:

1. A reciprocating bolt assembly for use in a direct gas firearm, the bolt assembly comprising:

a bolt carrier, the bolt carrier having a sealing surface;

a bolt, the bolt have a ring groove; and a ring set configured to provide a seal between the sealing surface and the ring groove, the ring set comprising a plurality of rings, wherein a first ring has a first ring gap defining a first angle and a second ring has a second ring gap defining a second angle, wherein the first and second angles are different to prevent gas from passing through the first and second ring gaps.

2. The bolt assembly of claim 1, wherein each of the plurality of rings in the ring set has a ring gap.

3. The bolt assembly of claim 1, wherein the ring set further comprises a third ring, wherein the third ring has a ring gap defining a third angle.

4. The bolt assembly of claim 3, wherein the angled ring gaps of the first, second and third rings are between about 15 and 75 degrees.

5. A direct gas firearm comprising:

a receiver configured to accept a bolt assembly, the receiver configured to accept gas pressure resulting from the firing of the firearm;

a bolt assembly slidably mounted to the receiver;

a bolt slidably mounted to the bolt assembly, the bolt having a ring groove; and a ring set comprising a plurality of rings, the ring set mounted to the ring groove, wherein a first ring has a first ring gap defining a first angle and a first orientation and a second ring has a second ring gap defining a second angle and a second orientation, wherein the first and second orientations are different to prevent gas from passing through the first and second ring gaps.

6. The firearm of claim 5, wherein the angle of the ring gap of the first ring is between about 15 and 75 degrees.

7. The firearm of claim 6, wherein the angle of the ring gap of the second ring is between about 15 and 75 degrees.

8. The firearm of claim 7, wherein the ring set further comprises a third ring, the third ring has ring gap.

9. The firearm of claim 5, wherein the at least one of the plurality of rings has a ring gap defined by an angle that is greater than 0 and less than 90 degrees.

10. The firearm of claim 5, wherein the plurality of rings comprises three rings with one of the rings having a ring gap defined by an angle that is greater than 0 and less than 90 degrees.

11. The firearm of claim 5, wherein the plurality of rings comprises two rings with one of the rings having a ring gap defined by an angle that is greater than 0 and less than 90 degrees.

* * * * *